US008992130B2

(12) United States Patent
Hörman et al.

(10) Patent No.: US 8,992,130 B2
(45) Date of Patent: Mar. 31, 2015

(54) ARRANGEMENT FOR A DOWN-THE-HOLE HAMMER DRILL FOR USE IN SOIL CONSOLIDATION THROUGH JET GROUTING

(75) Inventors: Magnus Hörman, Älta (SE); Peter F. Johansson, Stockholm (SE)

(73) Assignee: LKAB Wassara AB, Stockholm (SE)

( * ) Notice: Subject to any disclaimer, the term of this patent is extended or adjusted under 35 U.S.C. 154(b) by 106 days.

(21) Appl. No.: 13/145,093

(22) PCT Filed: Jan. 20, 2010

(86) PCT No.: PCT/SE2010/050052

§ 371 (c)(1),
(2), (4) Date: Nov. 4, 2011

(87) PCT Pub. No.: WO2010/090577

PCT Pub. Date: Aug. 12, 2010

(65) Prior Publication Data

US 2012/0039673 A1 Feb. 16, 2012

(30) Foreign Application Priority Data

Feb. 9, 2009 (SE) ..... 0900155

(51) Int. Cl.
*E21B 4/14* (2006.01)
*E21B 10/38* (2006.01)
(Continued)

(52) U.S. Cl.
CPC ... *E21B 4/14* (2013.01); *E02D 3/12* (2013.01); *E21B 33/138* (2013.01)
USPC ..... 405/269; 405/233; 405/266

(58) Field of Classification Search
CPC ..... E02D 3/12; E02D 3/123; E21B 4/14
USPC ..... 405/233, 241, 266, 267, 269
See application file for complete search history.

(56) References Cited

U.S. PATENT DOCUMENTS 3,200,599 A * 8/1965 Phares et al. ..... 405/241
4,449,856 A * 5/1984 Tokoro et al. ..... 405/269
(Continued)

FOREIGN PATENT DOCUMENTS

EP 0394255 A1 10/1990
EP 0777018 A1 6/1997
(Continued)

OTHER PUBLICATIONS

International Search Report received for PCT Patent Application No. PCT/SE2010/050052, mailed on May 10, 2010, 4 pages.

*Primary Examiner* — Benjamin Fiorello
(74) *Attorney, Agent, or Firm* — Morrison & Foerster LLP

(57) ABSTRACT

An arrangement for a down-the-hole hammer drill, for use in soil consolidation by jet grouting, and comprising a cylindrical machine housing, an impact mechanism driven by pressurised fluid that impacts onto a drill bit mounted in a chuck in the machine housing that allows reciprocating motion, whereby the machine housing has a central supply line for the driving fluid to the impact mechanism in which channels in the drill bit constitute outlets for used driving fluid. The machine housing is provided with a grouting nozzle for jet grouting, that the grouting nozzle is directed in a sideways direction and arranged at the periphery of the wall of the machine housing, that a rinsing channel for conducting a grouting mixture through the machine housing to the said grouting nozzle is arranged whereby the rinsing channel for the grouting mixture is separate from the supply line for the driving fluid of the impact mechanism.

4 Claims, 1 Drawing Sheet

Figure 3:
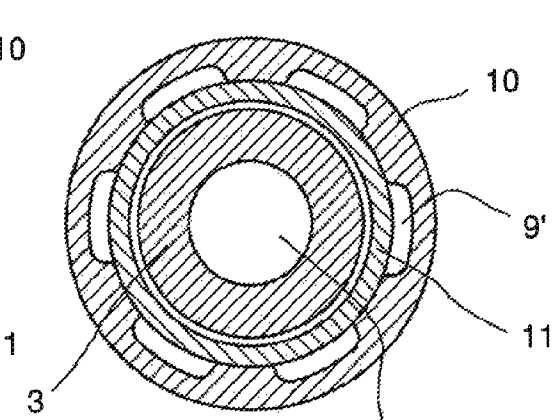

(51) Int. Cl.
*E02D 3/12* (2006.01)
*E21B 33/138* (2006.01)

(56) References Cited

U.S. PATENT DOCUMENTS 4,624,606 A * 11/1986 Nakanishi et al. ..... 405/269
5,107,944 A * 4/1992 Gustafsson ..... 175/296
5,219,247 A * 6/1993 Gemmi et al. ..... 405/241
5,256,004 A * 10/1993 Gemmi et al. ..... 405/237
5,423,636 A 6/1995 Mo
5,980,446 A * 11/1999 Loomis et al. ..... 588/250
6,109,836 A * 8/2000 Gritti ..... 405/266
6,457,910 B1 * 10/2002 Ludwig et al. ..... 405/259.1
6,955,504 B2 * 10/2005 Leibhard et al. ..... 405/259.5
7,029,207 B2 * 4/2006 Kim ..... 405/269

FOREIGN PATENT DOCUMENTS

JP 6-264435 A 9/1994
SE 512653 C2 4/2000
WO 99/27192 A1 6/1999

* cited by examiner

ARRANGEMENT FOR A DOWN-THE-HOLE HAMMER DRILL FOR USE IN SOIL CONSOLIDATION THROUGH JET GROUTING

CROSS-REFERENCE TO RELATED APPLICATIONS

This is a U.S. National Phase patent application of PCT/SE2010/050052, filed Jan. 20, 2010,which claims priority to Swedish Patent Application No. 0900155-3, filed Feb. 9,2009, each of which is hereby incorporated by reference in the present disclosure in its entirety.

The present invention concerns an arrangement for a down-the-hole hammer drill, in particular for soil consolidation through jet grouting, according to the introduction to claim 1.

During soil consolidation, it is normal to use a stabilisation arrangement that comprises a rock drilling arrangement of the type that has a drill string that consists of a number of drill pipes connected at their ends and a down-the-hole hammer drill with a drill bit mounted at its forward end. The drill string is given a feed force in a conventional manner by means of a feed beam with a rotation motor and a feed motor. The technology for soil consolidation has been long known, and it is used for the static upgrade of soil and ground-based structures. The load capacity of roads and similar civil engineering structures can be significantly improved through soil consolidation, which is the term used to describe the stabilisation of soil layers with a binding agent such as cement.

In order to carry out the soil consolidation, what is known as a "monitor" or "injector head" is arranged between the down-the-hole hammer drill itself and the drill string. This monitor is a unit that supports one or several grouting openings known as "nozzles", out through which a grouting mixture can be caused to flow at a high speed. A driving fluid, normally comprising a driving liquid in the form of water, is led down to the drill hammer with the aid of a central channel in the drill string in order to carry out the drilling operation. The said central channel, or a separate channel, is used to lead down a grouting mixture to the grouting nozzles in the grouting monitor. It is normal that the grouting mixture is constituted by a solution of cement and water. When the drill bit has reached its predetermined position in the drill-hole, jet grouting of the soil can begin at a pressure that is normally of a magnitude between one and some tens of megapascals (Mpa), whereby the drill string is withdrawn back up the hole while being rotated. It is normal that some form of valve arrangement is present in the said monitor, with the help of which the flow pathway down to the impact hammer can be blocked when the rock drilling arrangement is to be used for jet grouting and for leading the grouting mixture through the central channel of the drill string down to the grouting nozzles in the monitor. During jet grouting, the outwardly directed streams of grouting mixture that flow out from the grouting nozzles will be mixed with soil that is available within a diameter of approximately 1 meter from the centre of the hole, and will produce a pillar or column that is approximately as high as the depth of the drilled hole. The drill string is completely withdrawn from the drilled hole following the consolidation operation, and is thereafter ready to be used in a further drill and consolidation cycle.

An arrangement for soil consolidation is known from SE 512 653, the monitor of which arrangement is located above the down-the-hole hammer drill, a certain distance up on the drill string. It should be understood that it is necessary as a consequence to make the drill-hole larger than would otherwise be necessary, since the hole must be drilled deeper in order to ensure that the monitor is located at a pre-determined depth before the jet grouting can be started. In other words: the monitor must be located at such a depth that a pillar or column of the required height can be formed. The magnitude of the extra depth drilled normally corresponds to one extra hammer length.

An arrangement for soil consolidation is known from JP 06264435 that has separate supply lines for driving fluid to the impact mechanism of the hammer and for the grouting mixture to the jet grouting nozzles. The said jet grouting nozzles are located at the front end of the down-the-hole hammer drill in close vicinity to the drill bit. The down-the-hole hammer drill has a machine housing for the impact hammer. The machine housing is surrounded by an outer casing in the form of an outer pipe. The jet grouting nozzles are arranged in the outer casing whereby the grouting mixture is led forwards to the grouting nozzles outside of the machine housing in a channel that is formed between the outer casing and the outer surface of the machine housing. Due to the fact that there are separate supply lines for the driving fluid and the grouting mixture, and due to the fact that the jet grouting nozzles are located at the forward end of the down-the-hole hammer drill close to the drill bit, this known arrangement has the advantage that it is not required to make the drill-holes deeper than necessary during soil consolidation. The outer casing, however, and the arrangement of the grouting nozzles in the said casing lead not only to the down-the-hole hammer drill being larger, but also to it being more complicated in its design.

The aim of the present invention, therefore, is to provide an arrangement for a down-the-hole hammer drill that makes it possible to produce drill-holes that have dimensions that are very close to those determined or predetermined with respect not only to depth of drilling but also to hole diameter before jet grouting, while at the same time making it possible to give the down-the-hole hammer drill a more compact and simpler design than that of previously known down-the-hole hammer drills.

The said aim of the invention is achieved with an arrangement for a down-the-hole hammer drill that demonstrates the characteristics and properties that are specified in claim 1. Other advantages of the invention are made clear by the non-independent claims.

Figure 2:
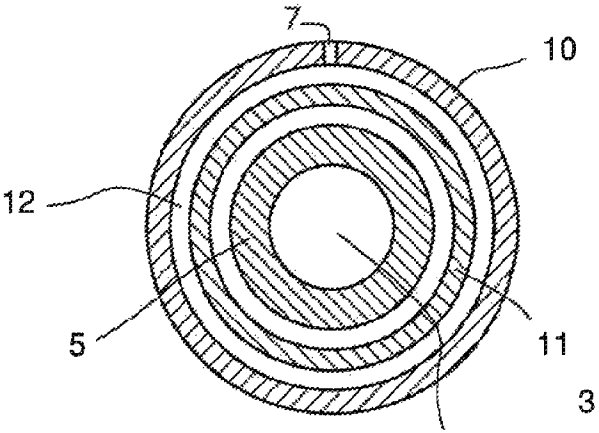
Figure 1:
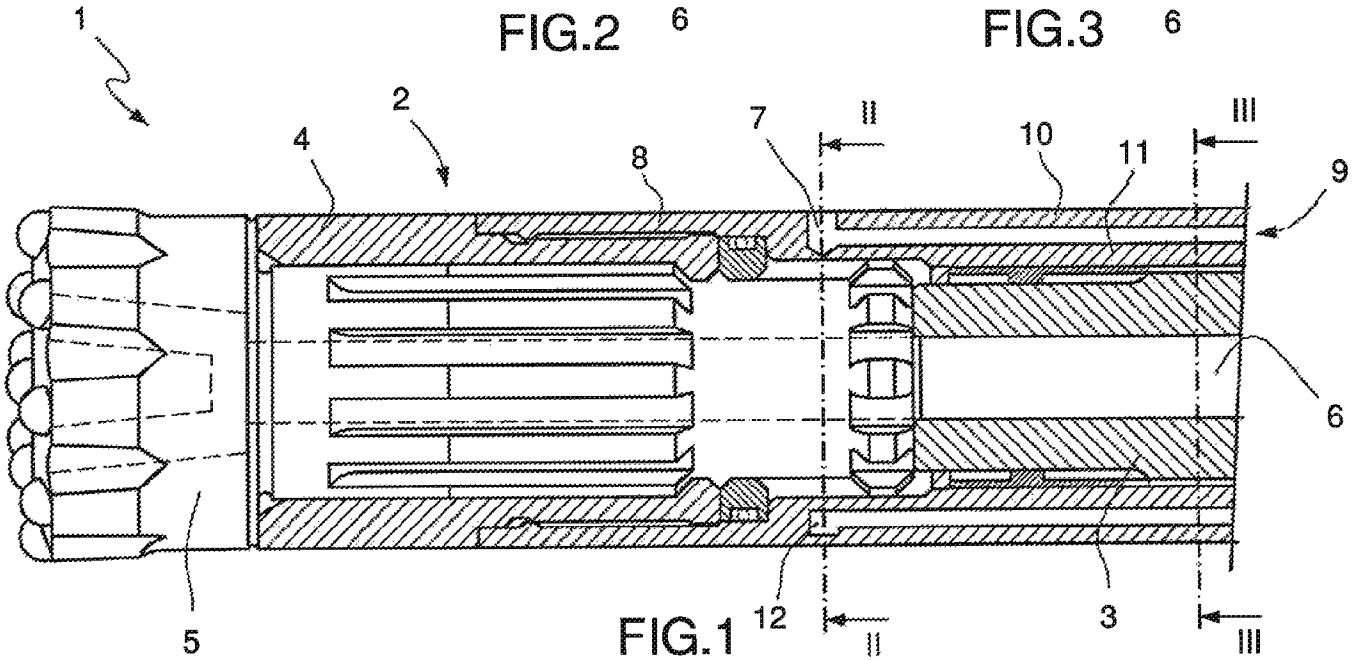

The invention will be described in more detail below in the form of a non-limiting embodiment with reference to the attached drawings in which:

FIG. 1 shows a longitudinal section through the forward end of a liquid-driven down-the-hole hammer drill, FIG. 2 shows a cross-section along the line II-II in FIG. 1, and FIG. 3 shows a cross-section along the line in FIG. 1.

FIG. 1 shows a forward end of a down-the-hole hammer drill 1 that has a machine housing 2 that is principally circularly symmetrical or tube-formed, in which is mounted an impact mechanism 3 driven by pressurised fluid, which impact mechanism is arranged to give impacts onto a drill bit 5 fixed mounted in a chuck 4 in a manner that allows reciprocating motion. The machine housing 2 has a central supply line 6 for driving liquid (water) and channels in the drill bit 5 (not shown in the drawing) through which channels used driving liquid can flow out, and through the influence of this drill cuttings generated during the drilling are driven backwards along the outer surface of the machine housing. This type of down-the-hole hammer drill has long been known and can be constituted by, for example, the type that is described in EP 0394255. Even if the present embodiment will be described based on a liquid-driven impact hammer, it should be realised that the arrangement according to the invention is not limited to use with hammers of this type, but can be arranged for an impact hammer that is driven by any suitable pressurised medium at all, such as air.

At the forward end of the down-the-hole hammer drill 1, which is the end that originates at the centre of the down-the-hole hammer drill and terminates next to the drill bit 5, a sideways-facing grouting nozzle 7 is arranged for leading out a grouting mixture that consists of a cement solution. Furthermore, as an integral part of the wall 8 of the machine housing 2 is arranged a rinsing channel, generally indicated by the reference number 9, for leading the grouting mixture through the machine housing and onwards to the grouting nozzle 7 in the forward end of the down-the-hole hammer drill. The said rinsing channel 9 extends along the longitudinal direction of the drill hammer 1 and ensures that the grouting nozzle 7 can be placed into and removed from fluid-transfer connection with equipment, not shown in the drawings and otherwise well-known, for the supply of a pressurised grouting mixture. The grouting mixture is led down from ground level at a relatively high pressure through a drill string that consists of joined drill pipes to the grouting nozzle 7 of the down-the-hole hammer drill 1 that is attached at the forward end of the drill string. The down-the-hole hammer drill 1 is provided with a grouting nozzle 7, and this means that there is no need for a special monitor unit on the drill string.

The pressure of the grouting mixture is normally of the magnitude between one and a few tens of megapascals (Mpa), whereby the cross-sectional area of the rinsing channel 9 arranged in the machine housing 2 must be sufficiently large to avoid flow losses that are too great. Therefore, it is appropriate that the cross-sectional area of the rinsing channel 9 amount to a value of at least between 60 $mm^2$ and 160 $mm^2$. In contrast to this, the opening of the grouting nozzle 7 must be so small that a sufficient speed of the outwardly flowing grouting mixture is obtained. It is normal that the diameter of the outlet is between 2 and 5 mm, whereby the outlet speed from the nozzle normally amounts to between 100 and a few hundred meters per second (m/s) in a direction radially outwards from the machine housing. In order to be able to vary the outlet area of the outlet nozzle, it is appropriate that the grouting nozzles be arranged as nozzles that can be exchanged designed to be screwed into threaded holes in the wall 8 of the machine housing 2 (such threaded holes are not shown in the drawings). The overall goal is to make it possible to form a pillar or a column in the hole, the radius of which can be varied in the interval from around 10 cm up to approximately 1 meter (m) during the jet grouting process. It is normal that the column is between 0.4 and 1.2 meters in diameter.

The rinsing channel 9 is shown in more detail in FIGS. 2 and 3. In order for the rinsing channel 9 that is integral in the wall 8 of the machine tube [sic, should be "housing"] 2 to offer the required cross-sectional area, the rinsing channel is designed as a number of subchannels 9', evenly distributed around the circumference of the machine tube [sic, again] 2 and extending, similar to the drilling operation, in the axial direction of the hammer. The machine housing 2 of the down-the-hole hammer drill 1 in the present embodiment is provided with a rinsing channel 9 that consists of six such subchannels 9'. Each one of the said subchannels 9' is designed as a longitudinal depression in the form of a track that has been formed, by a processing that removes shavings, in at least one of the opposing surfaces of two pipes 10, 11, one of which is positioned inside of the other. The pipes, one of which is positioned inside of the other, are joined by a suitable method, such as by welding at the ends or by shrink-fitting of the outer tube 10 onto the inner tube 11. The subchannels 9' transition into a ring-shaped compartment 12, formed as a surrounding radially track-shaped depression formed, by a process that removes shavings, in the inner wall of the outer tube 10, with which ring-shaped compartment 12 the grouting nozzle 7 communicates in such a manner that the grouting mixture is emitted directly from the said compartment. Due to the fact that the grouting mixture is collected from the subchannels 9' in the common compartment 12, an even distribution of pressure is achieved and in this way also an even flow radially outwards from the down-the-hole hammer drill 1.

The present invention is not limited to what has been described above and shown in the drawings: it can be changed and modified in several different ways within the scope of the innovative concept defined by the attached patent claims.

The Invention claimed is:

1. An arrangement for a down-the-hole hammer drill, for use in soil consolidation jet grouting, the arrangement comprising:

a cylindrical machine housing of a down-the-hole hammer, an impact mechanism driven by pressurised fluid that, mounted in the machine housing, is arranged to give impacts onto a drill bit fixed mounted in a chuck in the machine housing in a manner that allows reciprocating motion, a central supply line for supplying driving fluid to the impact mechanism in which channels in the drill bit constitute outlets for used driving fluid, a grouting nozzle for jet grouting, a rinsing channel for conducting a grouting mixture through the machine housing to the said grouting nozzle and being separate from the supply line for the driving fluid of the impact mechanism, wherein the grouting nozzle for jet grouting is directed in a sideways direction and so arranged at the periphery of a wall of the machine housing of the down-the-hole hammer that the grouting mixture delivered is directed radially outwards from the machine housing of the down-the-hole hammer, wherein the rinsing channel extends linearly in the axial direction of the hammer and is designed as an integral part of the wall of the machine housing, wherein the rinsing channel comprises a number of subchannels evenly distributed around the circumference of the machine housing, wherein the subchannels are connected to a single ring-shaped compartment that is connected to the grouting nozzle.

2. The arrangement according to claim 1, whereby the grouting nozzle is located at the forward end of the cylindrical machine housing.

3. The arrangement according to claim 1, whereby each subchannel is designed as a longitudinal depression in the form of a track that has been formed in at least one of the opposing surfaces of two pipes, one of which is positioned inside of the other and which together form the machine housing.

4. The arrangement according to claim 3, whereby the pipes, one of which is located inside of the other, are joined by means of welding or by shrink-fitting of the outer tube onto the inner.

* * * * *